US006194842B1

(12) United States Patent
Canova

(10) Patent No.: US 6,194,842 B1
(45) Date of Patent: Feb. 27, 2001

(54) SUPPLY CIRCUIT FOR DISCHARGE LAMPS WITH OVERVOLTAGE PROTECTION

(75) Inventor: Antonio Canova, Arezzo (IT)

(73) Assignee: MagneTek, S.P.A. (IT)

( * ) Notice: Subject to any disclaimer, the term of this patent is extended or adjusted under 35 U.S.C. 154(b) by 0 days.

(21) Appl. No.: 09/064,300

(22) Filed: Apr. 22, 1998

(30) Foreign Application Priority Data

Apr. 23, 1997 (EP) ..... 97830185

(51) Int. Cl.[7] ..... H05B 37/02
(52) U.S. Cl. ..... 315/225; 315/119; 315/127
(58) Field of Search ..... 315/119, 127, 315/224, 225, 291, 219

(56) References Cited

U.S. PATENT DOCUMENTS

| | | | | |
|---|---|---|---|---|
| 4,554,487 | * | 11/1985 | Nilssen | 315/224 |
| 5,322,951 | | 6/1994 | Turner et al. | 315/209 |
| 5,349,270 | | 9/1994 | Roll et al. | 315/209 |
| 5,635,799 | * | 6/1997 | Hesterman | 315/127 |
| 5,751,115 | * | 5/1998 | Jayaraman et al. | 315/225 |
| 5,925,990 | * | 7/1999 | Crouse et al. | 315/307 |

OTHER PUBLICATIONS

European Patent No. 0 113 451 A1 published Jul. 18, 1994.
European Patent No. 0 610 642 A1 published Aug. 17, 1994.

* cited by examiner

*Primary Examiner*—David Vu
(74) *Attorney, Agent, or Firm*—Waddey & Patterson; Mark J. Patterson

(57) ABSTRACT

A supply circuit used in electronic ballasts for discharge lamps having an inverter for generating a supply voltage at a specified switching frequency for a load circuit comprising at least one lamp and a resonant circuit in series with the electrodes of the lamp. The supply circuit also includes a control circuit connected to the load circuit and the inverter so as to reduce the supply voltage provided to the load circuit in case of defective operation of the lamp. The control circuit includes a band-pass filter centered on the switching frequency of the inverter, a level discriminator, and a logic circuit. The control circuit receives an input signal that is dependent on the voltage at a point of the load circuit, and it is filtered through a band-pass filter. The output signal from the band-pass filter is provided to the level discriminator, which determines whether the lamp being used is defective by the frequency of the voltage and provides a corresponding high or low signal to the logic circuit. The logic circuit then provides a signal to the inverter so as to turn off the supply to the load circuit in case of defective operation.

34 Claims, 3 Drawing Sheets

SUPPLY CIRCUIT FOR DISCHARGE LAMPS WITH OVERVOLTAGE PROTECTION

Be it known that Antonio Canova, residing at Via Po No.79/A, Montevarchi, Arezzo, Italy, 52025, a citizen of Italy, has invented a new and useful "Supply Circuit For Discharge Lamps With Overvoltage Protection."

BACKGROUND OF THE INVENTION

The present invention relates to a supply circuit with inverter for discharge lamps. More particularly the present invention relates to a supply circuit for discharge lamps with heated electrodes, in which an inverter comprising a set of electronic switches, turned on and off alternately, supply a load circuit having at least one lamp and an LC resonant circuit in series with the lamp.

Systems for controlling the voltage on the electrodes of a discharge lamp and which have the objective of modifying the behavior of the load circuit or of turning off the supply thereto in case of defective operation of the lamp, are often used in supply circuits of the type mentioned above, with the objective of preventing excessively high voltages from arising between the electrodes.

From European Patent Application EP-A-0 610 642, there is known a supply circuit with an inverter for discharge lamps, in which associated with the load circuit is a control circuit comprising a voltage-dependent resistor (VDR) in series with a dissipative element. When the voltage at one terminal of the VDR exceeds a threshold value (which occurs in the case of failure of the lamp to light following a defect therein, for example), the VDR becomes conducting with the consequence that the resonant circuit in series with the lamp receives an additional dissipative element. This modifies the quality factor of the circuit and hence reduces the voltage at the terminals of the lamp. Provision is further made for a timer circuit which turns off the supply to the load circuit should the overvoltage condition last for a time greater than a pre-set threshold value.

From European Patent Application EP-A-0 113 451, there is known a different overvoltage control system, in which a voltage-dependent resistor in series with a capacitor are inserted in parallel with a branch of the load circuit. In this case, when a voltage difference greater than a specified threshold value is generated between the terminals of the VDR, it becomes conducting and inserts an auxiliary capacitor into the load circuit, modifying the frequency of resonance of the resonant circuit in series with the lamp.

Traditional circuits for protection from overvoltages come into operation when the voltage between the electrodes of the lamp exceeds a threshold value. In the case of a defective lamp, and hence of the failure of this lamp to light, the voltage between the electrodes of the lamp reaches values of the order of 1000 V. Conversely, when the lamp is removed from the load circuit, the potential difference between the electrodes is of the order of 700 V. The circuits currently available are unable to discriminate between these two voltage values, which may moreover vary from one instance to another of the circuit. Consequently, the overvoltage circuits cut in anyway, turning off the supply with a pre-specified time (of the order of 300 ms) having elapsed from the onset of the establishment of a situation of overvoltage between the electrodes of the lamp. They are further unable to distinguish between the two conditions of a defective lamp and a removed lamp.

On the other hand, it would be appropriate to make provisions for a circuit which is able to discriminate between a situation of actual defective operation and a situation where a lamp is removed from the load circuit in such a way that the substitution of the lamp does not entail the disabling of the supply inverter of the load circuit. Thus, in currently known circuits, the disabling of the supply inverter is permanent and hence requires the intervention of the operator in order to reactivate the supply for the lamp, even when the disabling has occurred through simple substitution of the lamp rather than through a defect in operation thereof. On the other hand, a high current flows in the case of overvoltage due to a defect in the operation of the lamp in the load circuit which passes through the capacitor in parallel with the lamp. This anomalous condition may lead to the overstressing of the inverter and hence to damage thereto. Protection from overvoltage has the objective of preventing this consequence. Conversely, when the voltage in the load circuit increases on account of the lamp being removed, the current which flows in the circuit is practically zero, and hence the inverter does not experience the dangerous stresses which occur under conditions of a faulty lamp.

SUMMARY OF THE INVENTION

The objective of the present invention is the construction of a supply circuit for discharge lamps, with an overvoltage protection system, not exhibiting the drawbacks of the traditional circuits briefly described above.

More particularly the objective of the present invention is the construction of a supply circuit for discharge lamps with an overvoltage protection circuit which is able to discriminate between the conditions of failure to light on account of a defective lamp and the conditions of a removed lamp, and which will cut off the supply only when necessary, i.e., in the case of a defective lamp.

Essentially, starting from a supply circuit of the type defined above, the objectives indicated above, and other objectives and advantages which will become clear to those skilled in the art by reading the text which follows, are achieved by making provision for the overvoltage control circuit to comprise a band-pass filter centered on the switching frequency of the inverter, the input signal of which is dependent on the voltage at a specified point of the load circuit and the output signal from which is sent to control means associated with the inverter so as to turn off the supply for the load circuit in the case of defective operation.

The invention is based on the observation that, although the amplitude of the voltage between the electrodes of the lamp is of the same order of magnitude both in the case of defective operation and in the case of a removed lamp, the waveform of the voltage signal is, conversely, qualitatively different in the two cases. In case of failure to light through a defect in the lamp, the voltage between its electrodes has a substantially sinusoidal profile with a frequency corresponding to the switching frequency of the inverter. In case of a removed lamp, conversely, the waveform of the voltage signal at the terminals of the lamp exhibits, as well as a relatively limited component at the switching frequency, a strong signal content at the higher harmonics.

By detecting this voltage signal and filtering it through a band-pass filter centered on the switching frequency, a signal is therefore obtained at the output of the band-pass filter. This signal will be a high signal when the overvoltage established between the electrodes is due to defective operation of the lamp inserted into the load circuit. This signal will, conversely, be low when the overvoltage established between the electrodes is due to a removed lamp. In this last case, in fact, the signal component at the switching frequency is of modest strength with respect to the components at the higher harmonics, which are blocked by the band-pass filter.

The control circuit thereby becomes capable of discriminating between the conditions of defective operation and the conditions of a removed lamp and will be able, with suitable logic, to intervene on the supply inverter, selectively disabling the operation thereof.

Further and advantageous characteristics and embodiments of the circuit according to the invention are indicated in the appended claims and will be described in greater detail below.

In particular, a voltage divider, to which the band-pass filter is linked, can be arranged in parallel with a branch containing at least one component of the load circuit (for example the inductive component). More particularly the voltage divider can be placed in parallel with a branch comprising one of the electronic switches of the inverter and the inductive component of the resonant circuit in series with the electrodes of the lamp.

The band-pass filter can consist, in a particularly simple embodiment, of an inductor and a capacitor connected in parallel, with a resonant frequency corresponding to the switching frequency of the inverter.

DESCRIPTION OF THE PREFERRED EMBODIMENT

Figure 1:
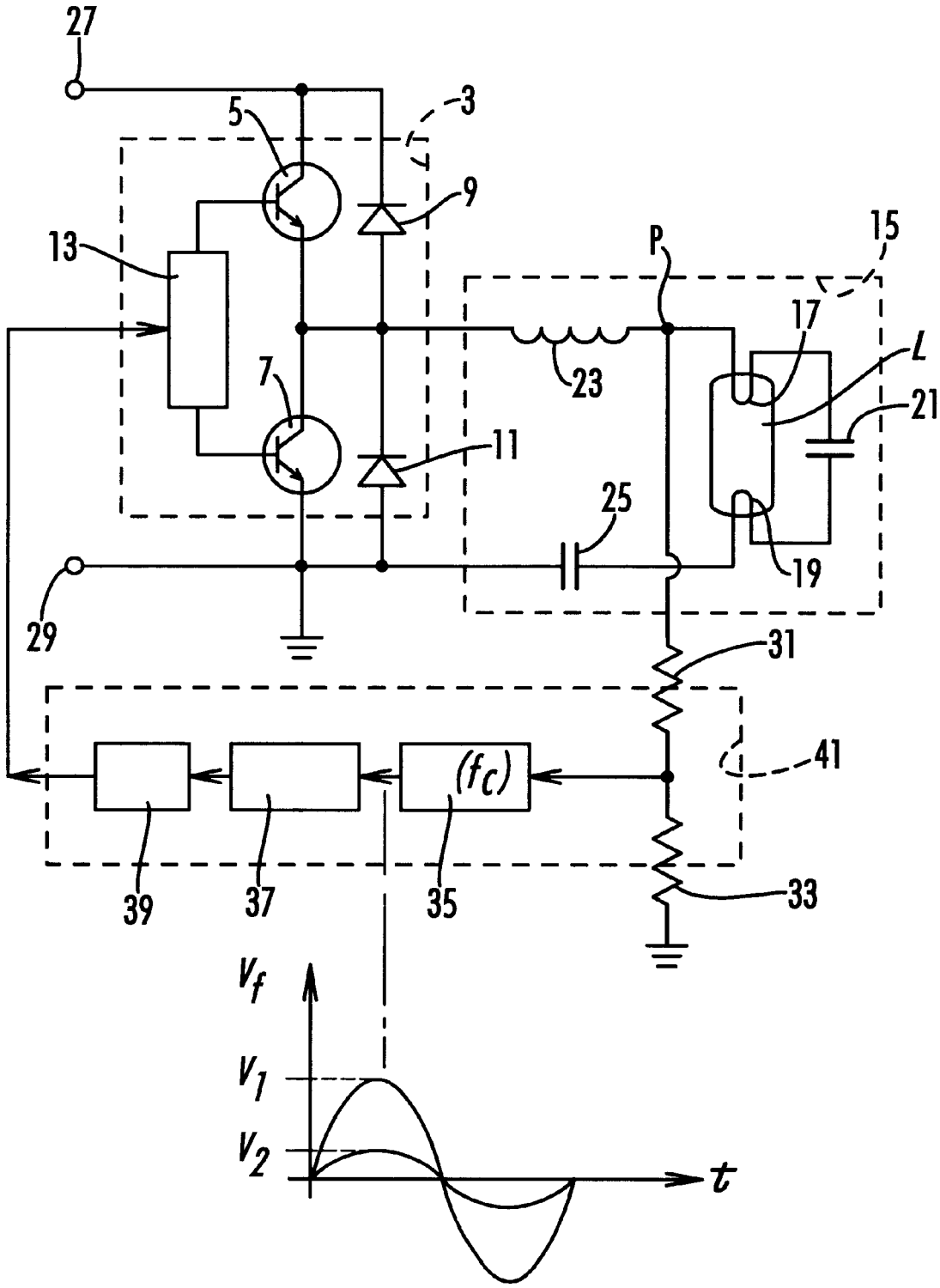
FIG. 1 is a schematic diagram of a circuit according to the invention, also graphically showing the voltage at the outputs of the band-pass filter.

Represented in FIG. 1, diagrammatically and limited to the elements relevant in the present description, is a supply circuit for the discharge lamp L with a supply inverter 3. The supply inverter 3 has two electronic switches 5 and 7 in a half-bridge configuration. Diodes 9 and 11 are placed respectively in parallel with the electronic switches 5 and 7. The label 13 generically and diagrammatically indicates the system for controlling the opening and closing of the electronic switches 5 and 7, of a type known in the art.

Arranged in parallel with the electronic switch 7 is a load circuit 15 which comprises, as well as the lamp L with its electrodes 17 and 19, a capacitor 21 in parallel with the lamp L and a resonant circuit in series with the electrodes 17 and 19, which in the example illustrated is shown diagrammatically with an inductive component 23 and a capacitive component 25.

The supply circuit now described is linked via two contacts 27 and 29 to a rectifier bridge (not illustrated) which supplies the inverter 3 with a rectified voltage at a frequency of double the frequency of the supply network. The load circuit 15 comprising the discharge lamp L is supplied with a voltage typically of the order of 10,000–100,000 Hz from the inverter 3.

With the ignition of the lamp L, a high voltage of the order of 1000 V is established between its two electrodes 17 and 19. This voltage should persist for an extremely limited interval of time, of the order of tens of or a few hundred milliseconds, necessary for the lamp L to fire. In case of defective operation of the lamp L, ignition is delayed and the voltage between the electrodes 17 and 19 persists at the high value of around 1000 V in the presence of a flow of high current through a capacitor 21 in parallel with the lamp L. This entails heavy stressing of the inverter 3 and it is therefore necessary to provide a control circuit 41 which, depending on the voltage at the point P of the load circuit 15, makes a provision for disabling the supply circuit in the case in which the overvoltage condition persists beyond a pre-set time threshold.

When the lamp L is absent from the load circuit 15, a high voltage, of the order of 700 V, is again established at the point P. However, under these conditions the current through the load circuit 15 is minimal and corresponds merely to the current through the stray capacitances of the supply circuit. Hence, in this case the supply circuit for the inverter 3 need not be disabled. The control circuit 41 according to the invention, which will be described below, makes it possible to discriminate between these two conditions of overvoltage on the electrodes 17 and 19 of the lamp L and hence makes it possible to turn off the supply in the case of defective operation only and not in the case of a removed lamp.

Figure 2:
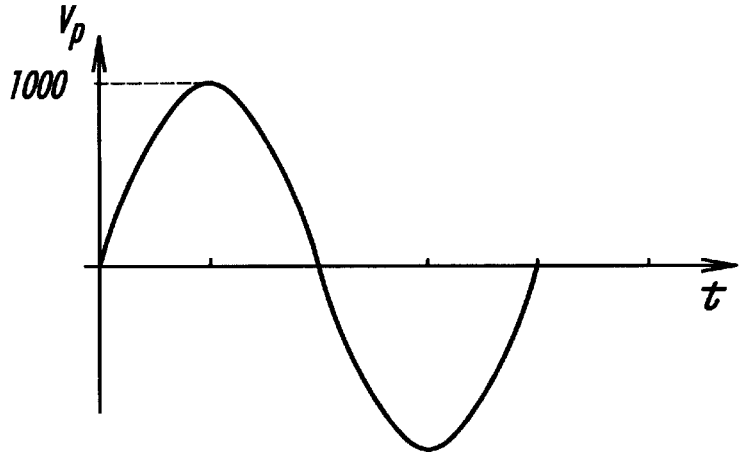
FIG. 2 is a graph of the waveform of the voltage signal between the electrodes of the lamp in the case of a defective lamp.
Figure 3:
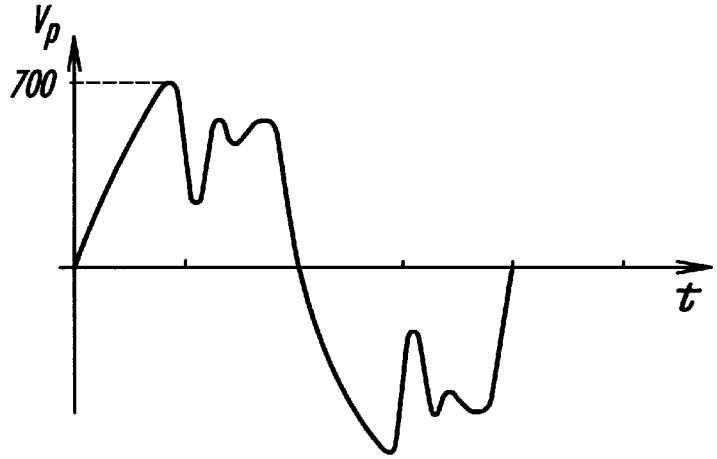
FIG. 3 is a graph of the waveform of the voltage signal between the electrodes of the lamp in the case of a removed lamp.
Figure 4:
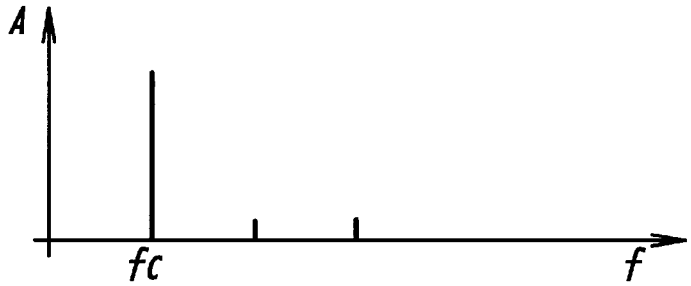
FIG. 4 is a graph representing the frequency spectrum of the voltage signal between the electrodes of the lamp in the case of a defective lamp.
Figure 5:
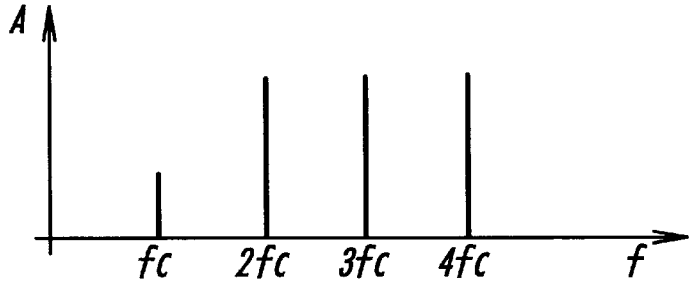
FIG. 5 is a graph representing the frequency spectrum of the voltage signal between the electrodes of the lamp in the case of a removed lamp.

Represented in FIGS. 2 and 3 is the waveform of the voltage signal at the point P of the load circuit 15. Represented in FIG. 2 is a substantially sinusoidal waveform with a frequency corresponding to the frequency $f_c$ of switching of the inverter 3. This is the waveform of the voltage signal detectable at the point P in the case of a defect in the operation of the lamp L. The amplitude of the signal is around 1000 V. Conversely, in the case of a removed lamp, the voltage signal at the point P takes the profile of FIG. 3 with an amplitude of around the same order of magnitude as the previous case (in the example around 700 V), but with a more complex harmonic content. FIGS. 4 and 5 show the frequency spectrum of the two signals. As may be seen in FIG. 4, the waveform of FIG. 2 is practically a sinusoidal wave with a frequency $f_c$, whereas the waveform of FIG. 3, to which the spectrum of FIG. 5 refers, has a modest harmonic content at the switching frequency $f_c$ and a large harmonic content at the higher harmonics.

The control circuit 41 according to the invention exploits this differing harmonic content of the voltage signals at the point P under the two conditions of a defective lamp and a removed lamp so as to discriminate the two cases of overvoltage and turn off the supply in the first case only. With this objective, a voltage divider 31 and 33, at the intermediate point of which is linked a band-pass filter 35 centered on the switching frequency $f_c$ of the inverter 3, is connected to the point P of the load circuit 15.

On account of the different harmonic content of the voltage signal in the case of a defective lamp and of a removed lamp, the output from the band-pass filter 35 centered on the frequency $f_c$ will be a sinusoidal signal of frequency $f_c$ with a large amplitude in the case of a defective lamp and a very small amplitude in the case of a removed lamp. This is represented qualitatively in the graph at the bottom of FIG. 1, where time is plotted along the abscissa and the output voltage from the band-pass filter 35 along the ordinate and in which the labels $V_1$ and $V_2$ indicate the amplitudes of the signal output by the band-pass filter 35 respectively in the case of a defective lamp and in the case of a removed lamp.

The signal output by the band-pass filter 35 is sent to a level discriminator 37, which dispatches a high signal to a logic unit 39 when the amplitude of the signal output by the band-pass filter 35 is equal to $V_1$, and a low signal when the amplitude of the signal output by the band-pass filter 35 is equal to $V_2$. The logic unit 39 is therefore able to discriminate between the two situations of a removed lamp or of a defective lamp and depending thereon will make provision to maintain the inverter 3 under supply conditions when the lamp L is absent from the load circuit 15, whereas it will make provision to disable the inverter 3 when the overvoltage at the point P is due to a defect in the lamp L.

Figure 6:
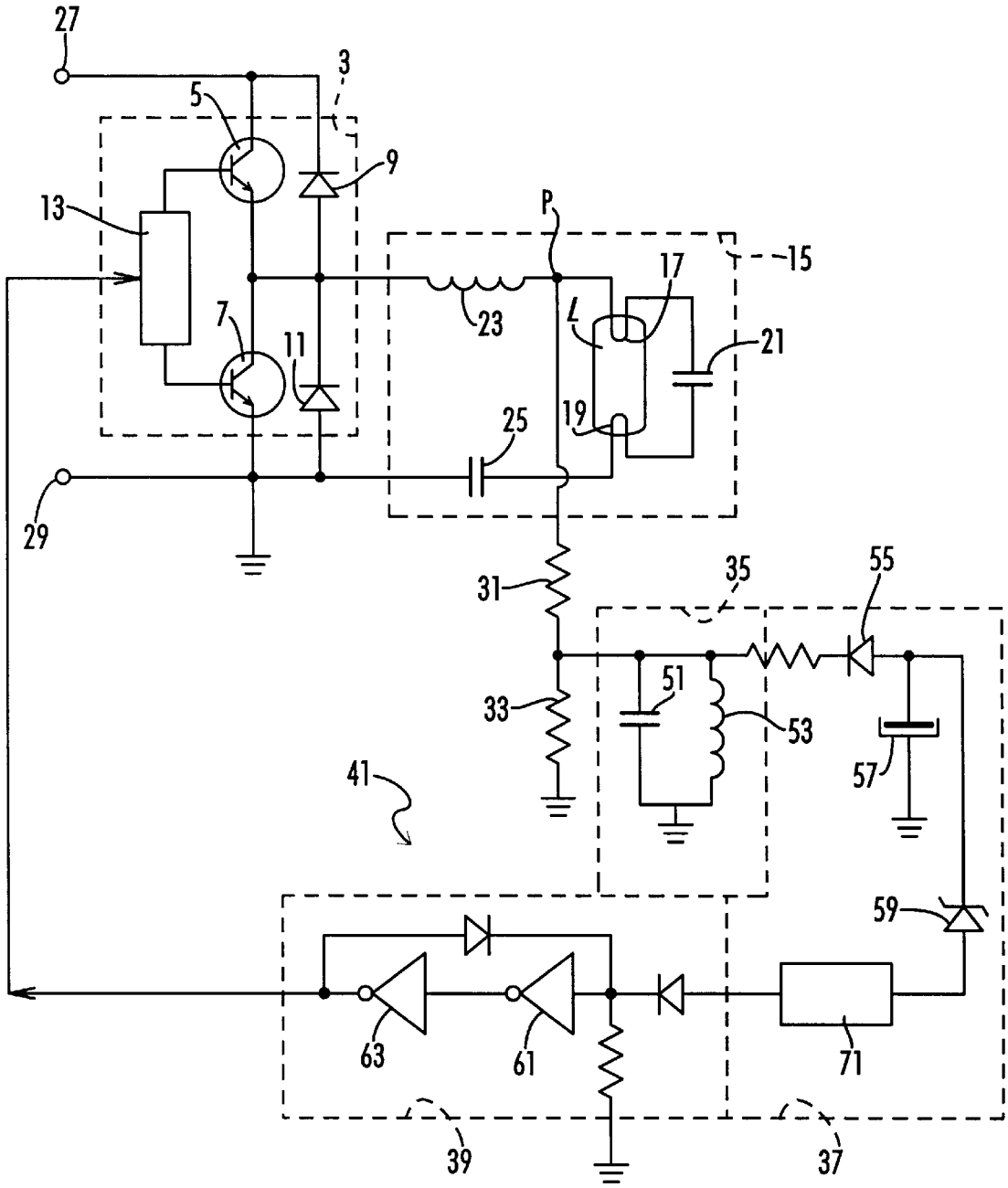
FIG. 6 is a detailed schematic diagram of the circuit of FIG. 1.

A practical embodiment of the control circuit 41 is shown in FIG. 6, which is represented at a functional level in FIG. 1. The elements of FIG. 6 which are identical to or correspond to those of FIG. 1 are indicated with the same reference numerals and will not be described again. In this embodiment the band-pass filter 35 consists of an LC circuit comprising a capacitor 51 and an inductor 53 connected in parallel which form a resonant circuit at the switching frequency $f_c$ of the inverter 3. The band-pass filter 35 is linked via a diode 55 to a capacitor 57, the capacitor 57 being charged at the voltage corresponding to the peak voltage of the signal output by the band-pass filter 35. The capacitor 57 is linked to the logic unit 39 via a Zener diode 59 (or some other type of threshold element), at the output of which will be present a low signal when the input voltage is less than the conduction voltage of the Zener diode 59 and a high signal when the input voltage is greater than the conduction voltage. The conduction voltage of the Zener diode 59 lies between the values $V_1$ and $V_2$ indicated in the graph at the bottom of FIG. 1.

In short, the signal at the output of the Zener diode 59 will be high only in the case of defective lamp and will remain low in the case of a removed lamp or of normal operation of the load circuit 15. This signal is sent to the logic unit 39 which consists of a latch circuit with two inverting gates 61 and 63 in series with positive feedback. With this arrangement the output from the inverting gate 63 will remain at low level in the case of normal operation or of a removed lamp whereas it will rise to high level and remain steady at this level, until the operator intervenes on the supply circuit, in the case of defective operation of the lamp. The signal output by the latch circuit is used to disable the inverter 3.

With the objective of avoiding the intervention of the protection circuit with each attempted ignition of the lamp L (even under conditions where the lamp L is intact), there is provided a delay circuit 71 with a delay time of the order of 100–200 ms. In this way the voltage peak which occurs for very brief instants at the moment of ignition of the lamp L even when the latter is not damaged, does not prompt any disabling of the supply circuit.

To achieve the disabling of the supply inverter 3 of the lamp L via the signal output by the logic unit 39, this signal can be employed for example to short-circuit the base of a electronic switch. This can be the typical solution for a supply circuit of the self-oscillating type. When the supply to the lamp L is achieved via an integrated control circuit (not shown), the signal generated by the logic unit 39 can be applied to an enabling/disabling pin of the integrated circuit.

It should be understood that the drawings show merely one example given solely as a practical illustration of the invention, it being possible for this invention to vary in its forms and arrangements without however departing from the scope of the concept underlying the invention. Thus, although there have been described particular embodiments of the present invention of a new and useful supply circuit for discharge lamps with overvoltage protection, it is not intended that such references be construed as limitations upon the scope of this invention except as set forth in the following claims.

What is claimed is:

1. A supply circuit for discharge lamps comprising:

an inverter for supplying the lamps with a supply voltage;

a load circuit connected to the inverter for receiving the supply voltage;

a filter connected to the inverter for receiving the supply voltage and creating a filtered signal representing only a portion of the supply voltage;

a control circuit connected to the filter for receiving and monitoring the filtered signal and causing the inverter to turn off the supply voltage provided to the load circuit in the case of a defective lamp.

2. The supply circuit of claim 1 wherein the inverter further comprises a pair of electronic switches which are turned on and off alternately at a switching frequency so as to generate the supply voltage at the switching frequency.

3. The supply circuit of claim 2 wherein the load circuit further comprises a fluorescent lamp and a resonant circuit connected in series with the lamp.

4. The supply circuit of claim 3 wherein the load circuit is electrically connected in parallel with one of the electronic switches.

5. The supply circuit of claim 1 wherein the control circuit further comprises a band-pass filter with a band of frequency centered on the switching frequency of the inverter.

6. The supply circuit of claim 5 wherein the band-pass filter comprises an inductor and a capacitor connected in parallel having a resonance frequency.

7. The supply circuit of claim 6 wherein the resonant frequency of the band-pass filter corresponds with the switching frequency of the inverter.

8. The supply circuit of claim 5 wherein the control circuit is connected to the load circuit to receive an input signal that is dependent on the voltage provided to the load circuit.

9. The supply circuit of claim 5 wherein the control circuit further comprises a level discriminator connected to the band-pass filter.

10. The supply circuit of claim 9 wherein the level discriminator further comprises a threshold element.

11. The supply circuit of claim 10 wherein the level discriminator further comprises a delay timer circuit.

12. The supply circuit of claim 11 wherein the level discriminator further comprises a capacitor which is charged by the voltage output by the band-pass filter.

13. The supply circuit of claim 9 wherein the control circuit further comprises a logic circuit connected to the level discriminator.

14. The supply circuit of claim 13 wherein the logic circuit comprises a pair of inverting gates and a diode with the inverting gates being connected in series and the diode connected in parallel with the inverting gates to provide a positive feedback.

15. The supply circuit of claim 13 wherein the control circuit is connected to the load circuit to receive an input signal that is dependent on the voltage provided to the load circuit.

16. The supply circuit of claim 15 wherein the output signal from the band-pass filter is provided to the level discriminator.

17. The supply circuit of claim 16 wherein a high or a low output signal from the level discriminator is provided to the logic circuit corresponding to the signal distributed from the band-pass filter.

18. The supply circuit of claim 17 wherein the logic circuit is connected to the inverter to provide a signal to turn off the supply to the load circuit in case of defective operation.

19. The supply circuit of claim 5 further comprising a voltage divider that is electrically connected to the band-pass filter.

20. The supply circuit of claim 19, wherein the voltage divider is electrically connected in parallel to a branch of the load circuit connected to one of the electronic switches and including the inductive component of the resonant circuit in series with the lamp.

21. A method for disabling an electronic ballast from providing a voltage to a defective lamp, the method comprising:

a. supplying a voltage from an inverter to a load circuit;

b. providing a voltage from the load circuit to a control circuit;

c. filtering the voltage provided to the control circuit through a band-pass filter centered on the switching frequency of the ballast to generate a filtered signal at the output of said band-pass filter;

d. comparing the filtered signal with a predetermined voltage; and e. disabling the inverter from providing a supply voltage when the voltage received from the load circuit is greater than the predetermined voltage.

22. The method of claim 21, further comprising:

a. filtering the voltage through a band-pass filter centered on the switching frequency of the ballast to generate a filtered signal at the output of said band-pass filter; and b. comparing the filtered signal with a predetermined voltage.

23. The method of claim 21 further comprising:

a. directing the voltage from the load circuit through a voltage divider;

b. filtering the voltage through a band-pass filter;

c. passing a high signal through a threshold element when the input voltage is greater than the conduction voltage of the threshold element;

d. sending the signal through a logic circuit;

e. providing the signal from the logic circuit to the inverter; and f. disabling the inverter when a high signal is provided from the logic circuit.

24. A method for disabling an electronic ballast from providing a voltage to a defective lamp, the method comprising:

a. filtering the voltage through a band-pass filter centered on the switching frequency of the ballast to generate a filtered signal at the output of said band-pass filter;

b. comparing the filtered signal with a predetermined voltage; and c. disabling an inverter of the electronic ballast from providing a supply voltage when the filtered signal is greater than the predetermined voltage.

25. A control circuit for a ballast supplying a supply signal to a discharge lamp connectable to a pair of lamp terminals comprising:

a. an input circuit electrically connected to at least one of the lamp terminals;

b. a sensing circuit electrically connected to the input circuit, the sensing circuit producing a sensing output responsive to a magnitude of a frequency component of the supply signal that varies in accordance with whether the discharge lamp is connected to the lamp terminals; and c. an output circuit electrically connected to the sensing output and having an output signal connected to the ballast that varies in accordance with whether the discharge lamp is connected to the lamp terminals.

26. The control circuit of claim 25 wherein the frequency component of the supply signal sensed by the sensing circuit corresponds to a switching frequency of an inverter in the ballast.

27. The control circuit of claim 26 wherein the sensing circuit comprises a filter tuned near the frequency component of the supply signal.

28. The control circuit of claim 27 wherein the output circuit comprises a level discriminator.

29. The control circuit of claim 28 wherein the level discriminator further comprises a threshold element.

30. The control circuit of claim 29 wherein the threshold element comprises a Zener diode.

31. The control circuit of claim 28 wherein the level discriminator further comprises a delay timer circuit.

32. The control circuit of claim 28 wherein the level discriminator further comprises a capacitor which is charged by the voltage output by the filter.

33. The control circuit of claim 28 further comprising a logic circuit connected to the level discriminator.

34. The control circuit of claim 33 wherein the logic circuit comprises a pair of inverting gates and a diode with the inverting gates being connected in series and the diode connected in parallel with the inverting gates to provide a positive feedback.

* * * * *